US012055302B2

(12) United States Patent
Bruckbauer et al.

(10) Patent No.: US 12,055,302 B2
(45) Date of Patent: Aug. 6, 2024

(54) CONTROL DEVICE FOR A MODULAR HOB SYSTEM

(71) Applicant: Wilhelm Bruckbauer, Neubeuern (DE)

(72) Inventors: Wilhelm Bruckbauer, Neubeuern (DE); Siegfried Gössler, Bad Aibling (DE); Bernd Niedermühlbichler, Schwaz (AT); Anton Schmöller, Kufstein (AT)

(73) Assignee: WILHELM BRUCKBAUER, Neubeuern (DE)

( * ) Notice: Subject to any disclaimer, the term of this patent is extended or adjusted under 35 U.S.C. 154(b) by 165 days.

(21) Appl. No.: 17/531,342

(22) Filed: Nov. 19, 2021

(65) Prior Publication Data

US 2022/0074597 A1 Mar. 10, 2022

Related U.S. Application Data

(63) Continuation of application No. 16/091,708, filed as application No. PCT/EP2017/058490 on Apr. 10, 2017, now Pat. No. 11,204,175.

(30) Foreign Application Priority Data

Apr. 8, 2016 (DE) ..... 10 2016 205 911.4

(51) Int. Cl.

| | |
|---|---|
| ***F24C 7/08*** | (2006.01) |
| ***F24C 3/12*** | (2006.01) |
| ***F24C 15/10*** | (2006.01) |
| ***F24C 15/20*** | (2006.01) |

(52) U.S. Cl.

CPC ..... *F24C 7/083* (2013.01); *F24C 3/124* (2013.01); *F24C 7/086* (2013.01); *F24C 15/2042* (2013.01); *F24C 15/106* (2013.01)

(58) Field of Classification Search

CPC .... F24C 15/106; F24C 15/2042; F24C 3/124; F24C 7/086; F24C 7/083; H01H 9/181; H01H 19/025; G05G 1/105

See application file for complete search history.

(56) References Cited

U.S. PATENT DOCUMENTS

| | | | | |
|---|---|---|---|---|
| D924,660 | S * | 7/2021 | Blum | D8/311 |
| 11,442,487 | B2 * | 9/2022 | Cowan | G05G 1/105 |
| 11,774,180 | B2 * | 10/2023 | Wang | F28D 15/0275 165/104.21 |
| 2004/0070574 | A1 * | 4/2004 | Wylie | F24C 7/082 345/184 |
| 2008/0023309 | A1 * | 1/2008 | Montalvo | H01H 9/181 200/332 |
| 2010/0182136 | A1 * | 7/2010 | Pryor | G06F 3/017 340/425.5 |
| 2015/0153048 | A1 * | 6/2015 | Moro | F23N 5/203 99/332 |
| 2020/0333015 | A1 * | 10/2020 | Ha | H01H 3/0206 |

FOREIGN PATENT DOCUMENTS

DE 102019123393 A1 * 3/2021

OTHER PUBLICATIONS

Machine Translation of Schridde, DE 10 2019 123 393, performed Jan. 4, 2024 (Year: 2019).*

* cited by examiner

*Primary Examiner* — Brian W Jennison
(74) *Attorney, Agent, or Firm* — McGlew and Tuttle, P.C.

(57) ABSTRACT

A modular hob system includes a control device for controlling all components of the hob system.

15 Claims, 3 Drawing Sheets

CONTROL DEVICE FOR A MODULAR HOB SYSTEM

CROSS REFERENCE TO RELATED APPLICATIONS

This application is a continuation under 37 CFR 1.53(b) of pending prior U.S. patent application Ser. No. 16/091,708 filed Oct. 5, 2018 and claims the benefit (35 U.S.C. § 120 and 365(c) of International Application PCT/EP2017/058490 filed Apr. 10, 2017, which designated inter alia the United States and which claims the priority of German Patent Application, Serial No. DE 10 2016 205 911.4, filed Apr. 8, 2016. The entire contents of each application is hereby incorporated by reference in its entirety.

TECHNICAL FIELD

The present invention relates to a control device for a modular hob system. The invention furthermore relates to a fume extractor apparatus having an integrated control device. Moreover, the invention relates to a hob. Finally, the invention relates to a modular hob system.

TECHNICAL BACKGROUND

By way of example, DE 10 2009 025 038 A1 discloses a hob system having hobs and a fume extractor apparatus. In the case of this system, each of the hobs has a dedicated, separate controller device. DE 10 2009 055 147 A1 discloses a system having a plurality of cooking points and a display unit.

SUMMARY

It is an object of the invention to improve a control device for a modular hob system.

This object is achieved by a control device for a modular hob system comprising at least two interfaces for connecting modularly configured hobs, and at least one signal connection for controlling at least one fume extractor apparatus. The heart of the invention consists in configuring a control device with at least two interfaces for connecting modular hobs. This makes it possible to control the hob, in particular a plurality of hobs, and a fume extractor apparatus, in particular a downdraft extractor fan, by means of the control device.

The control device can thus be a central control device for the hob system. It can be configured modularly. It can be configured in particular as a separate module, i.e. independently of the hobs and/or the fume extractor apparatus.

The hob system comprises in particular at least one hob and at least one fume extractor apparatus. The hob can be a glass ceramic hob, an induction hob, a teppan hob (teppanyaki hob), a gas hob, in particular an E-gas hob, a grill, a griddle, a deep fat fryer, a sous vide hob or some other hob. The hob is in particular an electric hob. The hob converts in particular electrical energy directly or indirectly into heat. For this purpose, the hob comprises electrical components, in particular heating filaments, halogen incandescent lamps, induction coils, micanite heating surfaces, planar heating elements or other heat-generating elements.

The fume extractor apparatus is in particular a downdraft extractor fan, that is to say a fume extractor which extracts the cooking fumes in a direction below a hob plane. Fume extractor apparatuses of this type are also referred to as downdraft systems.

The control device is configured in particular independently of the hobs actually connected. This should be understood to mean, in particular, that one and the same control device is equally suitable for controlling different hobs. The hobs that are controllable by means of the control device can be selected from the selection mentioned above. The functionality of the control device can automatically adapt to the hobs actually connected.

For this purpose, provision is made, in particular, for providing the control device with suitable interfaces for connecting the hobs.

The interfaces can in particular have sockets for receiving connecting plugs or be configured as sockets. This can involve in particular RJ sockets, in particular RJ22, RJ45 or RJ50 sockets.

The interfaces can also have plugs for receiving connecting sockets. The hobs can be connected to the control device in particular in each case by means of a connecting cable. The connecting cables can have connecting plugs and/or connecting sockets at their ends. At the opposite end they can in each case be fixedly connected to the hob.

The control device can be arranged in particular in a protective housing. The housing can be configured in a manner such that it is in particular liquid-tight and/or dust-tight, preferably at least splash-proof. It can be configured with or without a membrane, in particular with or without a liquid- and/or gas-tight membrane. It can additionally be provided with an insulation. It is thereby possible to avoid undesired heating in particular of the electronic constituents of the control device, in particular on account of radiant heat emanating from the hobs. The control device can be arranged in particular in a separate housing. The housing can be formed in particular from metal or plastic.

In accordance with one aspect of the invention, the control device comprises at least two, in particular three, four, five, six or more interfaces for connecting hobs, in particular for connecting different hobs. The hobs differ in particular with regard to their mechanisms for energy transmission. The flexibility of the control device is improved as a result. Firstly, the hobs can be controlled via the interfaces. Secondly, with the aid of the interfaces it is possible to communicate information about the operating state of the individual hobs to the control device.

In accordance with one aspect of the invention, the control device serves for controlling two or more hobs with a dedicated energy supply, in particular two or more hobs with a separate power cable.

In accordance with a further alternative, the control device serves for connecting at least two hobs which have no external energy supply.

In accordance with a further alternative, the control device serves for controlling at least two hobs, wherein at least one hob has a dedicated power supply system connection and at least one hob is supplied with energy via an interface of the control device.

The control device can in particular be configured as a bus system or comprise a bus system of this type. It can comprise in particular a so-called LIN bus (Local Interconnect Network Bus) or an EGO bus. It can also comprise a CAN bus (Controller Area Network Bus). Modified bus variants are also possible.

The bus can be configured in particular as a multi-master bus or a master-slave bus.

The bus technology can also comprise adapters, in particular for connection to higher- or low-level bus systems.

The hobs can in particular have in each case connections which correspond to the respective bus standard of the interfaces.

In accordance with a further aspect of the invention, the control device has at least one user interface having one or more touch-sensitive sensors, in particular a touch-sensitive screen, and/or a removable operating knob. The user interface can comprise in particular a combination of an input element, in particular in the form of a touch-sensitive screen, and an output unit, in particular in the form of a screen. The user interface is a means for exchanging information, in particular control information, with the user. The user interface is in particular an operating unit. The user interface allows inputs, in particular control inputs, by the user and/or constitutes a means for transferring information, in particular control information, to the user. For input by the user, the user interface can have for example pushbuttons, switches and/or touch-sensitive elements. For outputting information to the user, the user interface can comprise tactile and/or optical means. By way of example, the user interface can have illuminants, in particular LEDs, in particular incandescent lamps, and/or a screen, in particular a TFT screen. The screen can be configured in particular as an LED, LCD, OLED or as a projection screen.

The removable operating knob can have different functionalities depending on its relative position with respect to the control device. The control device can have in particular a touch-sensitive TFT display (TFT Touchdisplay, Thin Film Transistor display). This enables a particularly convenient control of the hobs and of the fume extractor apparatus.

In accordance with a further aspect of the invention, the touch-sensitive screen has redundant hardware components in the form of a multiply present touch-sensitive sensor arrangement and/or in the form of multiply present evaluation units. What can be achieved as a result is that the touch-sensitive screen is configured particularly robustly and reliably. Control inputs can thus be identified particularly reliably, in particular in the event of contamination of the touch-sensitive screen. The touch-sensitive sensor arrangement can be configured as an optical, resistive, capacitive and/or inductive sensor. The touch-sensitive sensor can be configured for example as a surface sensor. The touch-sensitive sensor can also be a film sensor or a glass sensor. Preferably, the touch-sensitive sensor arrangement is integrated into a TFT screen. The sensor arrangement and the display unit can also be configured separately from one another. They can be configured in particular as separate units which are optically connected, in particular bonded, to one another. It is possible, in particular, to bond a touch-sensitive sensor to a display unit by means of an optical binder. This leads to particularly advantageous optical properties. Moreover, this can lead to a particularly robust configuration. The evaluation unit is arranged in the signal line between control device and sensor arrangement. The evaluation unit serves for directly detecting the information received at the sensor. The evaluation unit detects the position at which the touch-sensitive screen is actuated. For forwarding this information, the evaluation unit is connected to the control device. The touch-sensitive sensor arrangement and/or the evaluation unit are formed multiply in the touch-sensitive screen. By way of example, the touch-sensitive sensor arrangement can be formed twice or multiply. The evaluation unit, too, can be present twice or multiply. If the touch-sensitive sensor arrangement and/or the evaluation unit are/is configured redundantly, then the redundant elements are each autonomously able to fulfil their function. The different evaluation units can carry out in particular a plausibility check of the detected input in order thereby to guarantee a functionally reliable identification of the input signal.

Preferably, a plurality of inputs can be read out simultaneously. An unambiguous identification, in particular, is ensured in this case.

The sensor arrangement can be in particular a multi-touch sensor.

The control device can also have a 7-segment display.

In accordance with a further aspect of the invention, the control device is operable by means of the operating knob. The operability of the control device is improved by this means, too. The operating knob enables in particular the operation of the control device independently of operation via the touch-sensitive screen. This is preferred by some users. The control device can be actuated in particular not only via the touch-sensitive screen but also—as an alternative thereto—by means of one or more operating knobs.

Alternatives which exclusively comprise one of these two options are likewise possible.

The operating knob has different functionalities depending on its relative position with respect to the control device, in particular depending on its positioning on an operating panel, in particularly on the touch-sensitive screen. The operation of the control device is further improved by this means, too.

It is possible, for example, for the operating knob to be used in different positions for controlling different hobs, on the one hand, and for controlling the fume extractor apparatus, on the other hand. In order to choose between these functions, it is sufficient to shift the operating knob accordingly on the screen.

As a result of placement of the knob, surface and sensor arrangement adapt independently to the options possible in each case.

In accordance with a further aspect of the invention, the operating knob can have display elements which appear different depending on the relative position of said operating knob with respect to the control device. The operation of the control device is further improved by this means, too.

The operating knob, in particular depending on its relative position with respect to the control device, can automatically identify which component of the hob system can be controlled in the respective position by means of the operating knob, and, depending thereon, display different items of information about the operating state of these components.

In accordance with a further alternative, in addition or as an alternative to the touch-sensitive screen and/or the operating knob, the control device can be operated by means of a remote control, in particular a wireless remote control. For this purpose, it can be provided with a corresponding receiver module. It is possible, in particular, to control the functions of the control device by means of a mobile radio unit, in particular by means of suitable application software, and/or with the aid of a sensor. In particular, a radio, Bluetooth, WLAN or IR sensor can serve as sensor.

In accordance with a further aspect of the invention, the control device is configured in such a way that it automatically adapts to the components actually connected thereto. In particular, the user interface is configured in such a way that it automatically adapts to the components actually connected to the control device. The control device has different hardware modules for automatic adaptation to the components connected to said control device. The hardware modules are specifically configured for linking and communication with the connected components. The control device has different software assemblies. These software assemblies are preconfigured in accordance with the potentially connected components. The software assemblies can be used in accordance with the actually connected components for the control of these components. The control device comprises software for automatically selecting the hardware components and/or the software assemblies. The mounting and installation process for the control device becomes simpler and more efficient as a result.

Different functionalities of the control device can also be provided or masked out via user inputs, in particular in an installation or setting menu. It is possible, in particular, to take account of connection information of the respective power supply system conditions, for example the maximum available power for the different components, for the control of the different components.

In accordance with a further aspect of the invention, the control device has a plurality of user interfaces which can be configured independently of one another for controlling all or a defined portion of the components connected to the control device. The control device can thus be operated from a plurality of positions by a user. In particular, the, in particular simultaneous, operation by a plurality of users is possible.

In accordance with a further aspect of the invention, the control device is configured as an encapsulated module. It can have in particular a dedicated housing. This facilitates the mounting of the control device. Moreover, this leads to a particularly robust embodiment of the control device. In accordance with a further aspect of the invention, the control device is configured as a separate module or integrated into a fume extractor apparatus. It can be integrated in particular into an installation frame of the fume extractor apparatus. This facilitates the arrangement of the fume extractor apparatus and of the hobs relative to the control device.

In accordance with a further aspect of the invention, the control device comprises internal sensors and/or interfaces for connecting external sensors. The sensors can be based on a thermoelectric, resistive, piezoelectric, capacitive, inductive, optical and/or magnetic principle of action. The sensors can be configured for identifying the position of the grease filter insert, as window contact switch, as temperature sensor, in particular for the hobs, in particular for the control device, in particular for the pots or pans situated on the hobs, and/or for identifying pots situated on the hobs. The sensors can also identify an obstruction of the fume extractor apparatus, in particular of the inlet opening thereof. The internal sensors are configured in particular for identifying the position of a grease filter of the fume extractor apparatus. The control device can thus react automatically to the states monitored by a sensor. By way of example, a closed-loop control of the components connected to the control device can be carried out. The control device can react for example to an absent or incorrectly installed grease filter in such a way that the functionality of the hob system is restricted or the user is made aware thereof by means of warning indications. The control device can contribute to safe and reliable operation of the hob.

In accordance with a further aspect of the invention, the control device, for automatically identifying the components connected to the interfaces, can detect a signal-based coding. The interfaces can be configured structurally identically. Alternatively, the control device has interfaces having structurally individual connection geometries. By way of example, the interfaces can be configured as asymmetrically fashioned sockets or plugs. The sockets or plugs of the interfaces or of the regions of the housing of the control device which surround them can have grooves or ribs in order to prevent erroneous connection of the different components.

The components can be connected to the interfaces in particular via connecting levers with asymmetrical plugs, in particular with angular plugs. In this case, the plugs are configured in particular in such a way that they can be plugged into the interface respectively provided therefor only in a single, predefined position and/or orientation. An inadvertently incorrect connection of components can thereby be prevented in a simple manner. The control device can thus be configured particularly simply upon connection of the components.

A further object of the invention is to improve a hob.

This object is achieved by means of a controller-free hob, that is to say a hob without an integrated controller, in particular without controller electronics. The construction of the hob is significantly simplified as a result. Moreover, the arrangement of cooking zones on the hob is simplified as a result. The hob can be configured in particular in a manner free of input fields, i.e. without an operating surface. It can be configured in particular without separate operating elements. The hob can be operated exclusively via the connecting cable to the control device.

The hobs configured as controller-free or free of operational control can be radiation-based or inductive hobs or be based on heat transfer. In particular, electric hobs or electrically controllable hobs are involved. In particular, a grill or a griddle can also be involved. The power output via the hobs configured as controller-free is variable and can be set by way of a hob controller. A hob without such a hob controller is particularly compact in terms of its dimensions. The hob controller can be arranged in particular in a separate controller unit outside the hob. By way of example, said hob controller is integrated into the control device. The controller-free hob can comprise an actuator for switching the power output via the hob. Said actuator can be controlled via the control device or a separate hob controller. By way of example, the hob configured as controller-free is an induction hob and the actuator is a power electronic unit that is controlled by the controller device for outputting a defined power via the hob. Alternatively, the hob is a gas hob and the actuator is a gas valve controlled via the control device.

The cooking zones can occupy in particular a total area which corresponds to at least 50%, in particular at least 60%, in particular at least 70%, in particular at least 80%, in particular at least 90%, in particular at least 95%, in particular at least 97%, in particular at least 99%, of the total area of the hob.

Removing the controller elements from the hob makes it possible to avoid in particular an influencing thereof by the heat generated by the hob and/or moisture and/or electromagnetic fields, in particular interference.

Moreover, the controller-free configuration of the hob has the consequence of enlarging the free spaces for the design configuration thereof.

In accordance with a further aspect of the invention, the hob has an electronic component for signal-based coding or a structurally individual connection geometry, in particular a specifically configured connection plug, for the automatic identification of said hob by the control device. The connection plug can be configured asymmetrically, in particular. It can be configured in an angular fashion, in particular. The hob can thus be identified by the control device in a simple manner.

A further object of the invention is to improve a fume extractor apparatus, in particular a fume extractor apparatus for a modular hob system.

This object is achieved by means of a fume extractor apparatus in the form of a downdraft extractor fan having an integrated control device in accordance with the above description. The advantages are evident from those of the control device.

The fume extractor apparatus can control in particular different hobs of a hob system. This can involve a decentralized control, in particular.

The fume extractor apparatus is, in particular, a fume extractor apparatus for cookers. In particular, a so-called downdraft extractor fan is involved, which is also referred to as a downdraft system.

The fume extractor apparatus can be configured as a mounting unit, in particular as a finished assembled mounting unit, which is insertable into a kitchen worktop. This facilitates the installation of the fume extractor apparatus.

The fume extractor apparatus is configured in particular in such a way that it is insertable into the worktop with a flush surface. It can be configured in such a way that it has no constituents projecting upward above the level of the worktop.

A further object of the invention is to improve a modular hob system.

This object is achieved by means of a modular hob system having a control device in accordance with the above description. The advantages are evident from those of the control device.

The hob system comprises at least one hob. It preferably comprises at least two hobs. It can also comprise three, four, five, six or more hobs. The hobs can be selected arbitrarily from a selection of different hobs. In particular, the number of hobs can be chosen in a variable fashion. The control device is configured in particular in such a way that it is suitable for controlling a different number of hobs and/or fume extractor apparatuses.

With regard to the possible alternatives of the hobs, reference should be made to the above description.

Correspondingly, with regard to the at least one fume extractor apparatus, reference should be made to the above description.

In accordance with a further aspect of the invention, the at least one hob is controlled by means of the control device. It is controlled in particular exclusively and/or completely by means of the control device. The hob or the hobs can therefore be free of operating panels and/or controller devices, in particular electronic controllers. As a result, it is possible to increase the area proportion of the hob which is provided with heating elements. Moreover, temperature influences on the operating panels are avoided as a result. Finally, greater freedom for the design of the hobs is made possible by the omission of the operating panels. Moreover, the construction of the hobs is simplified by the omission of the operating panels. As a result, they can be implemented in particular with a more space-saving construction. They can be configured in particular with a smaller structural height. The structural height of the hobs can be in particular less than 10 cm, in particular less than 5 cm, in particular less than 3 cm, in particular less than 2 cm, in particular less than 1 cm.

In accordance with a further aspect of the invention, the at least one control device is suitable for controlling all components of the hob system. It serves in particular for controlling all hobs and/or fume extractor apparatuses of the hob system. The control device can also be provided for controlling further components. It can have in particular interfaces for connecting further units.

The control device is connected to all hobs and/or fume extractor apparatuses of the hob system in particular in a signal-transmitting manner.

It forms a central control device for all hobs.

In accordance with one aspect of the invention, the hobs and the fume extractor apparatus are coupled to one another via the central control device. As a result, it is possible to couple the fume extractor apparatus to the operating state of the hob or hobs in an automated manner.

Further advantageous details of the invention are evident from the optional features described in summary below. These features can be combined arbitrarily with the features of the invention that have already been mentioned. An arbitrary combination of the features among one another is also possible.

The modular hob system can be embodied in a particularly compact design. In this case, the fume extractor apparatus is embodied as a downdraft extractor fan and the extraction opening of the fume extractor apparatus is arranged in particular between two hobs. The opening of the fume extractor apparatus terminates flush with the hob plane. It is in particular at a vertical distance from the hob plane which is less than 20 mm, in particular less than 10 mm, in particular less than 5 mm, in particular less than 2 mm. The motor of the fume extractor apparatus can be arranged directly below one of the hobs. The motor can also be arranged as a separate fan assembly at a distance from the hob system, in particular in the base region of a kitchen cupboard.

A channel for guiding the exhaust air can be arranged directly below the hobs. The channel extends at least in sections substantially in a horizontal direction. The channel for guiding the exhaust air can be configured for receiving a filter unit. The channel for guiding the exhaust air has an opening for introducing and removing the filter unit, which opening is closable by means of a flap. The presence of the filter unit, in particular the correct position thereof, can be detected by means of one or more sensors. A partly closed solution with inlet grilles is also possible for the channel for guiding the exhaust air.

The use of the filter unit enables the fume extractor apparatus to be operated as a circulating air system. In this case, the air purged of the cooking fumes is returned into the interior. The purged air is returned into the living area via a blow-off opening. Said blow-off opening can be oriented in the direction of the user toward the front, or toward the back, or toward the left side, or toward the right side, or upward, or downward. The control device is integrated into the housing of the fume extractor apparatus. The control device can be arranged on, in particular secured to, a carrier frame of the extraction opening of the fume extractor apparatus.

The filter unit can be exchangeable. It can be embodied in particular as a cartridge system.

The total height of the compact hob system is less than 300 mm, in particular less than 250 mm, in particular less than 200 mm, in particular less than 150 mm, in particular less than 100 mm. As a result of the particularly space-saving configuration of the compact hob system, it is possible to achieve an increase in the available storage space below the kitchen worktop.

The channel of the extraction guide can also be arranged at the rear side of the hobs and guide the exhaust air vertically downward. The exhaust air can also be guided toward one of the sides of a hob, toward the left or toward the right.

The hob system can comprise more than two hobs, in particular more than two separate hob modules. The hob modules can be different, in particular. Preferably, at least two of the hobs connected to the hob system are different. The hob system can also have a plurality of hobs of identical type. The hob system can also have more than one fume extractor apparatus. The extraction opening of the fume extractor apparatus can be arranged at the edge of the hob system. By way of example, the extraction opening can also be arranged between a plurality of hobs. The extraction opening can be formed in particular between two hobs and have the same edge length as the hobs. The extraction opening can also be arranged centrally or eccentrically between more than two hobs. The extraction opening can be configured as round, in particular circular, oval or rectangular, in particular non-square, in particular square.

The control device for the modular hob system is operated in the extra-low-voltage range, in particular with voltages of less than 50 V, in particular less than 30 V, in particular less than 20 V. The energy supply of the control device is carried out via a separate power supply unit.

The control device has a plurality of connections. For energy supply, the control device is connected to the power supply unit via a power lead. For the connection of the components, in particular of the hobs, to the control device, the latter comprises a plurality of wired interfaces. For the connection of the components, in particular of the hobs, to the control device, wireless interfaces can also be provided. The components can be connected to the control device via control lines. By way of example, the components comprise a selection from hobs, fume extractor apparatuses, exhaust air valves, lighting devices, multimedia systems and other consumers.

The interfaces are configured in such a way that different hobs can be connected thereto. The hobs differ in particular with regard to their mechanisms for energy transmission.

The control device can have additional interfaces for connecting an external sensor arrangement. The principle of action of the sensors connected to the control device can be thermoelectric, resistive, piezoelectric, capacitive, inductive, optical or magnetic. The sensors can be configured for identifying the position of the grease filter insert, as window contact switch, as temperature sensor, in particular for the hobs, pots and pans situated thereon, and/or for the control device, or for identifying pots situated on the hobs.

The control device furthermore comprises a user interface for exchanging control information with the user. The control device can have additional wireless interfaces in addition to the wired connections. The control device has for example a radio module, a radio-frequency module, a Bluetooth module and/or a WLAN module.

By way of example, the user interface can be connected to the control device via a wireless interface. The communication via the interfaces can be carried out by means of a bus system, in particular an LIN bus system or a multimaster bus system.

Preferably, the control device is decoupled from a power circuit by a galvanic isolation. The galvanic isolation can be configured capacitively inductively or by means of optocouplers. The control circuit of the control device is thus reliably decoupled from the power circuit.

The control device can comprise interfaces for exchanging service information, maintenance information and/or software updates. The wireless interfaces, in particular can be used for this purpose. The control device can also have a separate USB connection for this purpose. Preferably, software updates can be retrieved online via the Internet and be transmitted to the control device.

The control device for a modular hob system can be configured automatically in accordance with the connected components. The automatic configuration of the control device is carried out in particular without user inputs. The type, number, position and/or orientation of the connected components is identified automatically.

The components can for example be arranged at different positions of the modular hob system and/or be oriented in a manner rotated differently about a vertical axis. Hobs having more than one cooking point can thus be oriented in accordance with the customer's ideas in such a way that a specific cooking point is arranged for example at the front side of the worktop.

The automatic identification of the components connected to the control device can be carried out by way of a hardware and software coding or structurally by way of the connection geometry of the wired interfaces.

Components linked to the control device wirelessly can be automatically identified by means of a software coding.

The components connected to the control device can also include flap motors and/or roof flap motors besides hobs and extractor apparatuses.

The control device can be used for controlling exclusively hobs. Alternatively, the control device can also be used for controlling exclusively extractor apparatuses.

The control device can automatically combine together functions of different components connected thereto, as a result of which the operation of the modular hob system is improved.

An automatic activation of the fume extractor apparatus can be carried out upon activation of hobs.

The power of the fume extractor apparatus can be automatically adapted in accordance with the number and power of the activated hobs.

Flap motors and/or roof flap motors and/or further devices that have to be switched can be switched upon activation of the hobs.

Sensor information can be used for taking a decision about the automatic activation of the extractor apparatus or other components by the control device.

It is also possible for components to be switched off by the control device. Hobs can be switched off if a specific temperature value is exceeded. A pot removed from a hob can be identified by a pot identification. In this case, too, the control device can provide a signal for hob switch-off.

The controller can also deenergize components, in particular hobs, which are not supplied by the same current source.

By way of example, the control device can also switch off the fume extractor apparatus if all hobs are deactivated or a specific period of time has elapsed after deactivation of all hobs.

The control device has a user interface for exchanging information with the user. The control device can comprise a TFT screen. Via the TFT screen, power information of the connected components, temperature information, maintenance information, configuration information, sensor information and/or service information can be made accessible to the user. For inputs by the user, the screen can have a touch-sensitive layer and thus be configured in the form of a touchscreen. The touch-sensitive layer can be configured as a resistive, capacitive, inductive or optical sensor. A TFT screen having a touch-sensitive layer allows the input of control commands by the user in a particularly simple and reliable manner.

For efficient operation by the user, the control device can be configured to represent different display variants via the TFT screen. The components connected to the control device can be represented symbolically. For fast operation, in a first display variant, it suffices to flick or swipe the symbol of a connected component in order to control the latter. By way of example, the power of a hob can be controlled by flicking or swiping the TFT screen. The swiping or flicking can be carried out in rectilinear, arcuate or circular fashion. Combined flicking/swiping and tapping can also be carried out. In a second display variant, the components connected to the control device can be controlled in a detailed manner. For controlling the components connected to the control device, plus/minus buttons are displayed, for example, which can be actuated by tapping. The first display variant is characterized in that it only makes available a proper subset of the possible control options by comparison with the second display variant. A further (non-empty) subset of the possible control options is not made available in the first display variant.

The automatic configuration of the control device comprises the automatic configuration of the user interface. In accordance with the components connected to the control device different display variants can be represented on the TFT screen. The symbols corresponding to the connected components are automatically arranged on the TFT screen. For the connected components, individual control options can respectively be provided to the user. The display variants represented via the TFT screen can be automatically configured or individually designed.

The TFT screen of the control device can be fitted to the underside of a glass plate in such a way that it is substantially invisible from the top side of the glass plate in the switched-off state. For this purpose, the glass plate is light-transmissive to the extent of less than 90%, in particular less than 80%, in particular less than 70%, in particular less than 50%. The glass plate can be tinted or coated with an only partly light-transmissive film.

A display having naturally black pixels is used for the TFT screen.

Advantageously, the TFT screen has a particularly intense backlighting. The backlighting preferably has an intensity of at least 600 cd/m$^2$, in particular at least 900 cd/m$^2$, in particular at least 1000 cd/m$^2$.

The TFT screen is adhesively bonded to the glass plate in particular in liquid fashion, in particular without blisters (optical bonding).

The touch-sensitive TFT screen can be embodied in redundant fashion. For the redundant configuration of the touch-sensitive TFT screen, the touch-sensitive sensor and/or the evaluation unit connected thereto are configured in redundant fashion. In one advantageous embodiment variant, the evaluation unit is embodied twice and the touch-sensitive sensor is embodied once. The configuration of the evaluation unit with two-fold redundancy allows a plausibility comparison of the sensed inputs. The redundant configuration of the touch-sensitive TFT screen allows the reliable identification of user inputs even in the event of contamination of the TFT screen by, for example, splashes of fat.

The control device can be configured for dual operation. The control device can have two or more user interfaces. All components connected to the control device can be controlled via each user interface. The control device can also be configured in such a way that only a portion of the components connected to the control device can be controlled via the respective user interface.

The control device can be configured as an encapsulated module and comprise a dedicated housing. The housing can be configured as fluid-tight, in particular liquid-tight. The control device can be arranged outside the hobs, in particular on the kitchen worktop, or be integrated into the latter. The control device can also be integrated into a hob. Alternatively, the control device can be arranged between the hobs. The control device can be integrated into the fume extractor apparatus. In particular, the user interface of the control device can be integrated into the fume extractor apparatus. The control device can be fitted to the carrier frame of the extraction opening of the fume extractor apparatus. In one advantageous embodiment, the TFT screen of the control device and also the carrier frame of the extraction opening are jointly fitted to a glass plate, in particular adhesively bonded to the latter. The control device can also be screwed to the carrier frame. It can be connected to the carrier frame in particular in a releasable manner. In accordance with one alternative, the control device is connected to the carrier frame in a non-releasable manner.

The modular hob system comprises two circuits, a control circuit and a power circuit (or load circuit). The power circuit serves for supplying the electrical consumers with energy. Electrical consumers are the components connected to the control device, such as hobs and fume extractor apparatus. The power circuit is connected to the electrical power supply system. The control circuit is decoupled from the power circuit, in particular by the galvanic isolation. The control device is part of the control circuit. Damage to the control device is reliably avoided by virtue of the isolation of control and power circuits.

The components connected to the control device can be connected to different types of energy sources for energy supply.

The control device can be connected in particular to an electrical power supply system at 50 Hz or 60 Hz. It can be operated with an operating voltage of either 230 V, 240 V or 110 V. It can be connected to a single-phase, two-phase, three-phase, four-phase or five-phase power supply system.

The components can have a gas connection, a hot water connection or a steam connection.

The control device can also completely control the components connected to it whilst providing the energy supply. A separate connection of the components to an energy supply device is therefore not necessary.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
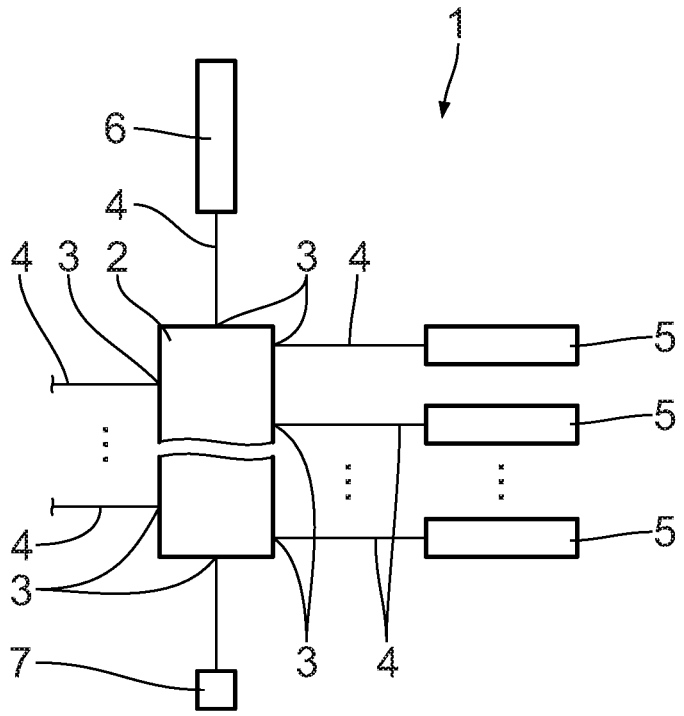
FIG. 1 is a schematic view showing the constituents of a modular hob system with a central control device.

Various details of a hob system 1 are described below with reference to the figures FIG. 1 shows very schematically the basic construction of the hob system 1. The hob system 1 comprises a central control device 2. The control device 2 has a multiplicity of interfaces 3. It is connected to further components, in particular hobs 5, in a signal-transmitting manner by means of control lines 4.

The hob system 1 comprises in particular a plurality of hobs 5. The hobs 5 can be glass ceramic hobs, radiant element hobs, induction hobs, teppan hobs, gas hobs, in particular E-gas hobs, grill hobs, griddles or other hobs. A deep fat fryer or a sous vide unit can also be involved. The hobs 5 are preferably electric hobs, i.e. hobs which convert electrical energy directly or indirectly into heat.

Moreover, the hob system 1 comprises a fume extractor apparatus 6. The fume extractor apparatus 6 is a downdraft extractor fan, in particular.

In principle, the hob system 1 can also comprise further elements or units. It is possible in principle, for example, to connect an oven and/or a steamer and/or a microwave appliance and/or an automatic coffee machine and/or further electrical appliances, for example a refrigerator, a freezer, a kettle or lighting, to the control device 2.

The control device 2 comprises in particular sensors that can be used to detect whether and respectively to which interfaces 3 hobs 5 or fume extractor apparatuses 6 or other appliances are connected. The sensors can be used in particular to detect what kind of hobs 5 is involved here.

For operating the control device 2 an operating unit 7 is provided. The operating unit 7 is connected to the control device 2 in a data-transmitting manner.

The operating unit 7 can comprise one or more touch-sensitive sensors, in particular one or more touch-sensitive screens 9, in particular thin film transistor displays (TFT displays).

The display of the touch-sensitive screen 9 can be designed depending on the hobs 5 and/or fume extractor apparatuses 6 connected to the control device 2. Preferably, the control device 2 is configured in such a way that the touch-sensitive screen 9, that is to say the display thereof, adapts automatically to the appliances that are in each case actually connected to the control device 2.

The touch-sensitive screen 9 can also be used for displaying further information and/or signals. It is possible, for example, to use the touch-sensitive screen 9 as a display for consumer electronics appliances, for example for displaying films, in particular as a TV screen. The appliances provided for this purpose can also be connected to the control device 2. As an alternative thereto, they can be connected directly to the touch-sensitive screen 9.

The operating unit 7 can also be operable by means of one or more operating knobs 8. The operating knobs 8 can be removable, in particular. The operating knob 8 can have different functionalities in particular depending on its relative position with respect to the control device 2.

Figure 2:
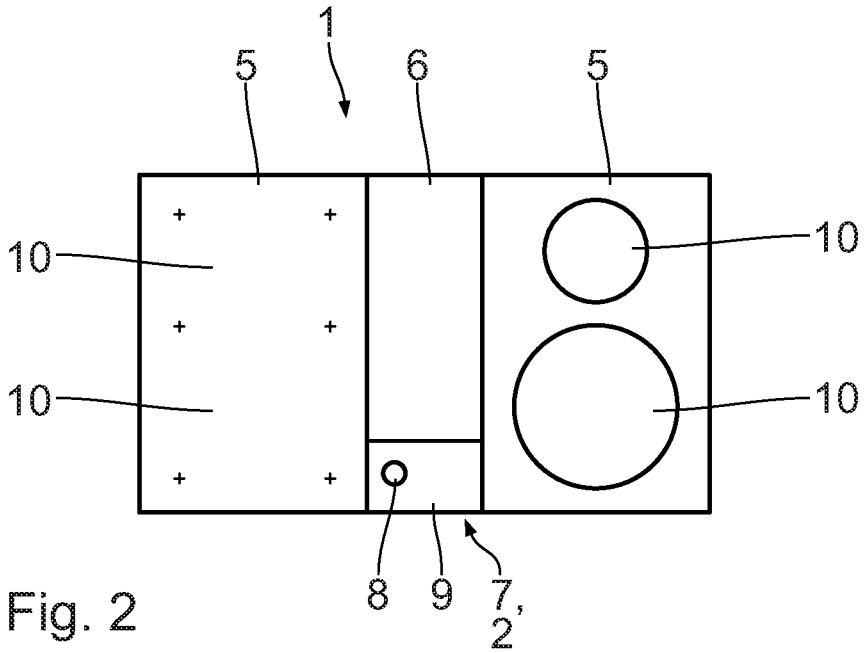
FIG. 2 is a schematic view from above of a modular hob system with two hob units, a fume extractor apparatus and a control device.
Figure 3:
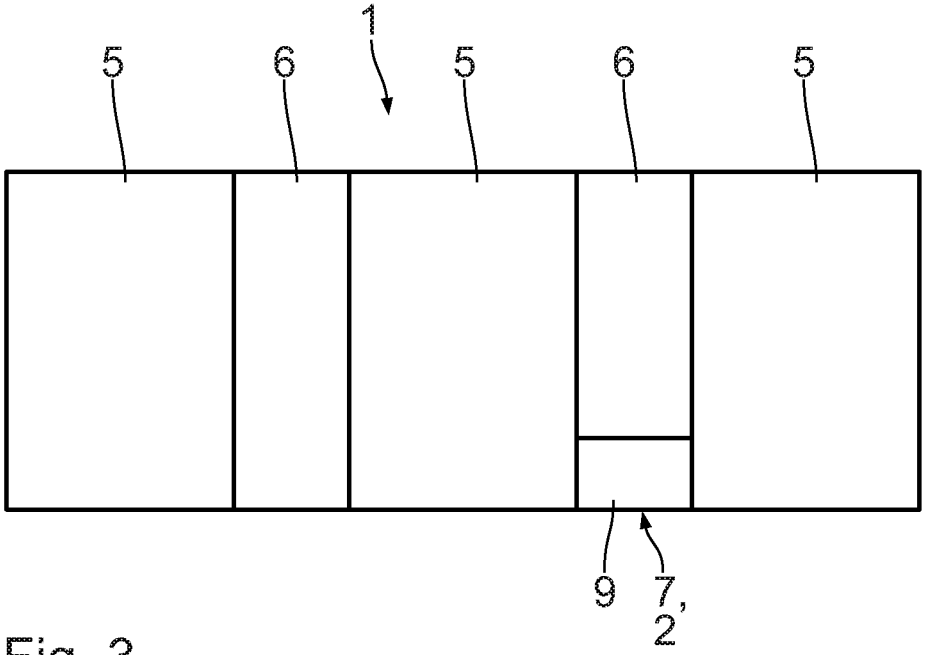
FIG. 3 is a view in accordance with FIG. 2 with three hob units, two fume extractor apparatuses and a control device.

As is illustrated schematically in FIGS. 2 and 3, the hob system 1 can comprise different hobs 5. The hob system 1 can also comprise a plurality of identical hobs 5.

The hob system 1 can also comprise a plurality of fume extractor apparatuses 6. The latter, too, can all be controllable by means of the control device 2. As is illustrated schematically in FIG. 3 (on the right), the control device 2 can be integrated into one of the fume extractor apparatuses 6. It is also possible for the fume extractor apparatus 6 to be configured as controller-free and to be connected to the control device 2 in a signal-transmitting manner by means of a control line 4 for control purposes (FIG. 3, on the left).

The joint control of the fume extractor apparatus 6 and of the hobs 5 by means of the control device 2 makes it possible to couple the control of the fume extractor apparatus 6 to that of the hobs 5.

The hobs 5 can be configured in particular in each case without a dedicated, separate control device, in particular without control electronics. The hobs 5 are configured in particular as controller-free. They can be configured in particular as non-autonomous, non-independent. In this case, they must be connected to the control device 2 for the purpose of operation, i.e. be connected to the control device 2 in a signal-transmitting manner.

As a result of the controller-free configuration of the hobs 5, a temperature influence on the operational control thereof is avoided. Moreover, adverse effects resulting from moisture and/or electromagnetic interference can be avoided as a result.

The hobs 5 can be free of operating panels, in particular. The flexibility of the arrangement of cooking zones 10 on the hobs 5 is increased as a result. The cooking zones 10 can be arranged in particular substantially in the entire region of the hobs 5. It is possible, in particular, to configure the hobs 5 with cooking zones 10 substantially over the whole area. The cooking zones 10 can occupy in particular an area of more than 50%, in particular more than 60%, in particular more than 70%, in particular more than 80%, in particular more than 90%, in particular more than 95%, of the total area of one of the hobs 5.

The hob system 1, in particular the hobs 5, are configured modularly, in particular.

The hobs 5 are controlled in particular exclusively and/or completely by means of the control device 2. For this purpose, they are connected to the control device 2 in a signal-transmitting manner by means of the control lines 4.

The control lines 4 can simultaneously also serve for the power supply of the hobs 5. As an alternative thereto, the hobs 5 can have separate power lines, in particular connection plugs.

As is illustrated schematically in FIGS. 2 and 3, the control device 2 can be integrated into the module of the fume extractor apparatus 6. The control device 2 and the fume extractor apparatus 6 can be integrated in particular in a common mounting unit. In this case, it is possible to dispense with a separate interface 3, in particular a separate control line 4 between the control device 2 and the fume extractor apparatus 6.

As an alternative thereto, the control device 2 can be configured as a separate module. This is illustrated schematically and by way of example in FIG. 4.

A configuration of the control device 2 as a separate module makes it possible to arrange the control device 2, in particular the operating unit 7, at a distance from the hobs 5 and/or the fume extractor apparatus 6.

Figure 4:
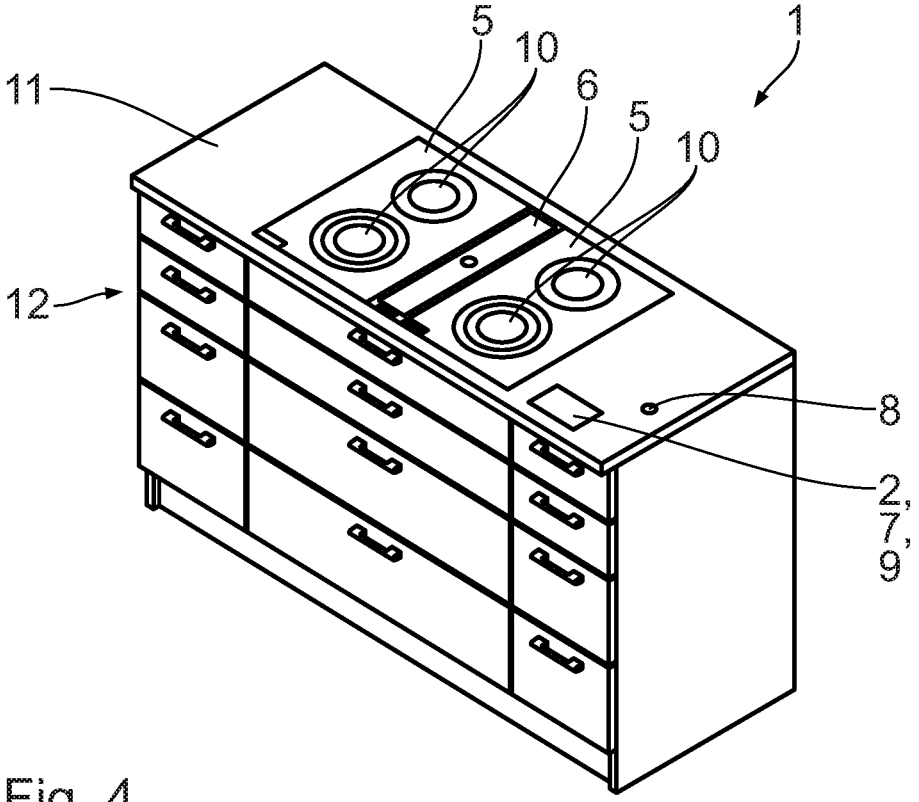
FIG. 4 is a perspective view that schematically shows a hob system integrated into an item of furniture with two hob units, a fume extractor apparatus and a separate control device.

As is likewise illustrated in FIG. 4, the operating knob 8 can be removable.

An arrangement of the hob system 1 in a worktop 11 on a kitchen base cabinet 12 is illustrated by way of example in FIG. 4. Ventilation channels for leading away the cooking fumes are not illustrated in more specific detail in FIG. 4. For corresponding details and further features of the fume extractor apparatus 6, reference should be made in particular to DE 10 2009 025 038 A1 and DE 10 2007 002 241 A1, the entire contents of each of the references are hereby incorporated in the present application by reference.

The configuration of the hobs 5 without a controller makes it possible in particular to construct said hobs with an extremely small structural height. The structural height or installation depth of the hobs 5 can be in particular less than 10 cm, in particular less than 5 cm, in particular less than 3 cm, in particular less than 2 cm, in particular less than 1 cm.

Figure 5:
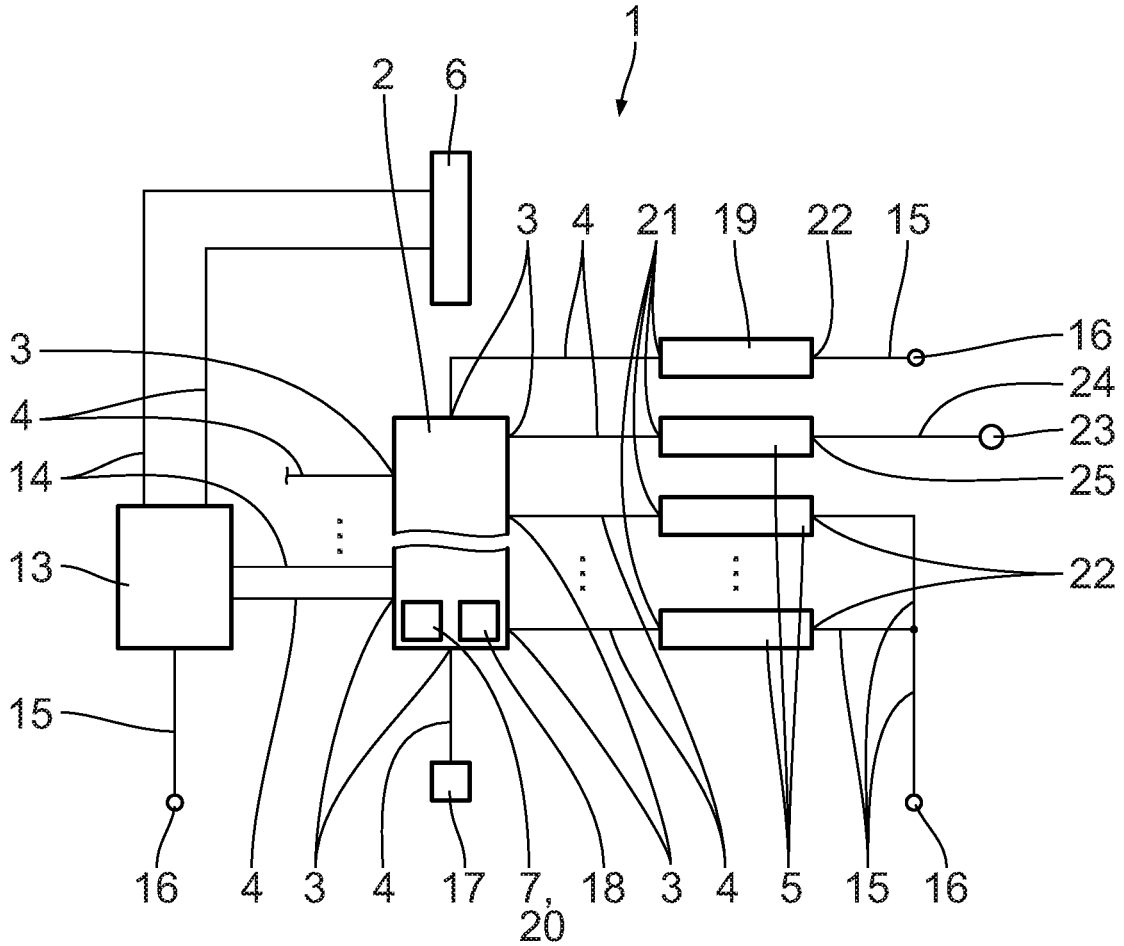
FIG. 5 is a schematic view showing the constituents of a modular hob system with a central control device in accordance with one alternative.

FIG. 5 schematically shows the basic construction of the hob system 1 in accordance with one alternative. The control device 2 is connected to a power supply unit 13 via extra-low-voltage lines 14. The power supply unit 13 is connected to the electrical power supply system 16 by a power supply system connection line 15 and supplies the control device 2 with power, in particular in the extra-low-voltage range. The power supply unit 13 thus decouples the power circuit from the control circuit. The control device 2 is connected to external sensors 17 via control lines. External sensors 17 can be used for example for monitoring the temperatures of the hobs 5, for identifying pots or for identifying a window position. Alternatively or additionally, the control device 2 has internal sensors 18. Internal sensors 18 are used, inter alia, for detecting the grease filter position.

The internal sensors 18 can also be used for temperature monitoring. Overheating of the hob system can be reliably prevented as a result.

A further consumer 19 is connected to the control device 2 and is connected to the electrical power supply system 16. The consumer 19 can be lighting. The control device 2 furthermore comprises a user interface 20 in the form of a touch-sensitive TFT screen. Consumer 19 and hobs 5 are connected to the control device 2 via a control connection 21 and to the electrical power supply system 16 via a power supply system connection 22. Consumer 19 and hobs 5 can alternatively be connected to further energy sources 23 via energy lines 24 and an energy connection 25. By way of example, the hob 5 is a gas hob and the energy source 23 is a gas connection.

While specific embodiments of the invention have been shown and described in detail to illustrate the application of the principles of the invention, it will be understood that the invention may be embodied otherwise without departing from such principles.

What is claimed is:

1. A modular hob system, comprising:

components comprising at least one hob and at least one fume extractor apparatus;

at least one control device, with at least one interface for connecting the at least one hob; and at least one user interface having a removable operating knob for operating the at least one control device, the removable operating knob being configured to have different control functionalities to control different components of the at least one hob and the at least one fume extractor in different relative positions with respect to the at least one control device, wherein the operating knob comprises display elements, which appear different depending on the relative position of the operating knob with respect to the at least one control device.

2. The modular hob system as claimed in claim 1, wherein the operating knob is configured to automatically identify which of the at least one hob and the at least one fume extractor apparatus can be controlled in the respective relative position of the operating knob with respect to the at least one control device.

3. The modular hob system as claimed in claim 2, wherein the operating knob is configured to display different items of information about the operating state of the at least one hob and the at least one fume extractor that can be controlled in the respective relative position of the operating knob with respect to the at least one control device.

4. The modular hob system as claimed in claim 1, wherein the control device comprises a touch-sensitive screen.

5. The modular hob system as claimed in claim 1, wherein the at least one user interface is connected to the at least one control device via a wireless interface.

6. The modular hob system as claimed in claim 1, wherein the at least one control device comprises at least one receiver module such that the functions of the at least one control device can be controlled by a wireless remote control.

7. A control device for a hob system comprising components comprising at least one hob and at least one fume extractor apparatus, the control device comprising:

at least one interface for connecting at least one hob; and at least one user interface having a removable operating knob for operating the control device, the removable operating knob being configured to have different control functionalities to control different components of the at least one hob and the at least one fume extractor apparatus in different relative positions with respect to the control device, wherein the operating knob comprises display elements, which appear different depending on the relative position of the operating knob with respect to the control device.

8. The control device as claimed in claim 7, wherein the at least one user interface is connected to the control device via a wireless interface.

9. The control device as claimed in claim 7, further comprising at least one receiver module for controlling the functions of the control device by a wireless remote control.

10. An operating knob for operating a control device for a hob system comprising components comprising at least one hob and at least one fume extractor apparatus, wherein the operating knob is configured to be removable from the control device, the operating knob being configured to have different control functionalities to control different components of the at least one hob and the at least one fume extractor apparatus in different relative positions with respect to the control device, wherein the operating knob comprises display elements, which appear different depending on the relative position of the operating knob with respect to the control device.

11. The operating knob as claimed in claim 10, wherein the operating knob is configured to automatically identify which of the at least one hob and the at least one fume extractor apparatus can be controlled in the respective relative position of the operating knob with respect to the control device.

12. The operating knob as claimed in claim 11, wherein the operating knob is configured to display different items of information about the operating state of the at least one hob and the at least one fume extractor apparatus that can be controlled in the respective relative position of the operating knob with respect to the control device.

13. The operating knob as claimed in claim 11, wherein the display elements are configured to automatically display the control functionalities associated with at least one of the at least one hob and the at least one fume extractor apparatus based on the relative position of the operating knob with respect to the control device.

14. The control device as claimed in claim 7, wherein the display elements are configured to automatically display the control functionalities associated with at least one of the at least one hob and the at least one fume extractor apparatus based on the relative position of the operating knob with respect to the control device.

15. The modular hob system as claimed in claim 1, wherein the display elements are configured to automatically display the control functionalities associated with at least one of the at least one hob and the at least one fume extractor apparatus based on the relative position of the operating knob with respect to the control device.

* * * * *